US008691077B2

(12) United States Patent
Sadler et al.

(10) Patent No.: US 8,691,077 B2
(45) Date of Patent: Apr. 8, 2014

(54) PROCESS FOR CONVERTING A HYDROCARBON STREAM, AND OPTIONALLY PRODUCING A HYDROCRACKED DISTILLATE

(75) Inventors: Clayton C. Sadler, Arlington Heights, IL (US); Christopher D. Gosling, Roselle, IL (US)

(73) Assignee: UOP LLC, Des Plaines, IL (US)

( * ) Notice: Subject to any disclaimer, the term of this patent is extended or adjusted under 35 U.S.C. 154(b) by 200 days.

(21) Appl. No.: 13/418,788

(22) Filed: Mar. 13, 2012

(65) Prior Publication Data

US 2013/0240406 A1 Sep. 19, 2013

(51) Int. Cl.

| | |
|---|---|
| ***C10G 47/26*** | (2006.01) |
| ***C10G 65/10*** | (2006.01) |
| ***C10G 9/00*** | (2006.01) |
| ***C10G 69/06*** | (2006.01) |

(52) U.S. Cl.
USPC ..... 208/59; 208/55; 208/106; 208/108

(58) Field of Classification Search
USPC ..... 208/46, 49, 50, 58, 59, 106, 107, 108, 208/113, 118, 308, 311
See application file for complete search history.

(56) References Cited

U.S. PATENT DOCUMENTS

| | | | |
|---|---|---|---|
| 2,310,317 | A | 2/1943 | Roberts |
| 2,388,055 | A | 10/1945 | Hemminger |
| 2,719,114 | A | 9/1955 | Leffer |
| 2,775,546 | A | 12/1956 | Kimberlin, Jr. et al. |
| 2,899,376 | A | 8/1959 | Krebs et al. |
| 3,470,084 | A | 9/1969 | Scott |
| 3,907,664 | A | 9/1975 | Janssen et al. |
| 4,090,948 | A | 5/1978 | Schwarzenbek |
| 4,388,152 | A | 6/1983 | Wasson et al. |
| 4,420,388 | A | 12/1983 | Bertolacini et al. |
| 4,518,487 | A | 5/1985 | Graf et al. |
| 5,007,998 | A | 4/1991 | Gruia |
| 5,154,818 | A | 10/1992 | Harandi et al. |
| 5,348,928 | A | 9/1994 | Kukes et al. |
| 5,474,977 | A | 12/1995 | Gatsis |
| 5,665,223 | A | 9/1997 | Bogdan |
| 5,755,955 | A | 5/1998 | Benham et al. |
| 6,454,934 | B2 | 9/2002 | Inomata et al. |
| 6,469,223 | B2 | 10/2002 | Kelly et al. |
| 6,740,788 | B1 | 5/2004 | Maher et al. |
| 6,793,804 | B1 | 9/2004 | Lindsay et al. |
| 7,005,058 | B1 | 2/2006 | Towler |
| 7,074,321 | B1 | 7/2006 | Kalnes |
| 7,169,368 | B1 | 1/2007 | Sullivan et al. |
| 7,247,233 | B1 | 7/2007 | Hedrick et al. |

(Continued)

OTHER PUBLICATIONS

Gillis, et al., Upgrading Residues to Maximize Distillate Yields, 2009, UOP, p. 1-19.*

(Continued)

*Primary Examiner* — Walter D Griffin
*Assistant Examiner* — Derek Mueller
(74) *Attorney, Agent, or Firm* — James C Paschall

(57) ABSTRACT

One exemplary embodiment can be a process for converting a hydrocarbon stream. The process can include passing the hydrocarbon stream having one or more C40$^+$ hydrocarbons to a slurry hydrocracking zone to obtain a distillate hydrocarbon stream having one or more C9-C22 hydrocarbons, and passing the distillate hydrocarbon stream to a hydrocracking zone for selectively hydrocracking aromatic compounds including at least two rings obtaining a processed distillate product.

20 Claims, 4 Drawing Sheets

(56) References Cited

U.S. PATENT DOCUMENTS

| | | | |
|---|---|---|---|
| 7,261,807 | B2 | 8/2007 | Henry et al. |
| 7,312,370 | B2 | 12/2007 | Pittman et al. |
| 7,591,940 | B2 | 9/2009 | Kalnes |
| 7,601,254 | B2 | 10/2009 | Gosling |
| 7,727,490 | B2 | 6/2010 | Zhou |
| 7,803,267 | B2 | 9/2010 | Chester et al. |
| 7,906,013 | B2 | 3/2011 | Kokayeff et al. |
| 7,951,290 | B2 | 5/2011 | Thakkar et al. |
| 2008/0035527 | A1 | 2/2008 | Eng et al. |
| 2010/0116712 | A1 | 5/2010 | Dziabala et al. |
| 2010/0168488 | A1 | 7/2010 | Mehlberg et al. |
| 2010/0248946 | A1 | 9/2010 | Bauer et al. |
| 2011/0303580 | A1 | 12/2011 | Haizmann |
| 2011/0306490 | A1 | 12/2011 | Bhattacharyya et al. |

OTHER PUBLICATIONS

Ackelson, "UOP Unicracking Process for Hydrocracking", Handbook of Petroleum Refining Processes, 2003, vol. Third Edition, pp. 7.23-7.33.

Towler, "Emerging Technology for Refining and Petrochemicals", 2011 Asia Refining, Petrochemicals & Gas Processing Tour, 62 pages.

"Heavy Oil Processing—New Flowscheme to Maximize Olefins and Aromatics", UOP-SABIC Meeting Saudi Arabia, pp. 12 pages, 2008.

Hughes et al., "ConocoPhillips Delayed Coking Process", "Handbook of Petroleum Refining Processes", 2003, vol. Third Edition, Pace(s) 12.3-12.31.

Figure of Integrated Refining-Petrochemical Complex in Commercial Use Prior to Feb. 2011, 1 Page.

Langston et al., "Lyondell ,Citgo Refining Company and Criterion Catalyst Company L.P. A Quality Partnership for the Future", National Petroleum Refiners Association 1998 Annual Meeting Paper, Mar. 15, 1998, p. 12 pages.

"MOL Selects Syn Technology", Petroleum Technology Quarterly, Spring 2000, vol. 5, No. 1, pp. 148-149.

"Refining Processes 2008: Hydrotreating, Diesel", Hydrocarbon Processing, Sep. 2008, vol. 87, No. 9, pp. 75.

* cited by examiner

PROCESS FOR CONVERTING A HYDROCARBON STREAM, AND OPTIONALLY PRODUCING A HYDROCRACKED DISTILLATE

FIELD OF THE INVENTION

This invention generally relates to a process for converting a hydrocarbon stream, and optionally producing a processed distillate product.

DESCRIPTION OF THE RELATED ART

Often, heavier hydrocarbons in a refining complex can be cracked to produce more valuable products, such as aromatics, or fuels, such as gasoline or diesel fuel. As an example, a light cycle oil can be obtained from a heavier oil in a catalytic cracking process. Unfortunately, such light cycle oil streams can be relatively small, and as a consequence, the economics of further processing the stream to produce more valuable products may be limited. Thus, even if a selective hydrocracking process can increase the value of the light cycle oil stream, the lack of sufficient feedstock can result in the lack of an economic justification for selective hydrocracking.

Additionally, a refining complex may also process heavier feeds such as atmospheric or vacuum residues and produce a distillate product. Often, such distillate products can be provided to a distillate hydrotreater. Unfortunately, often the inclusion of a lower quality cracked feed, such as a light coker gas oil or a slurry hydrocracked distillate, can require the hydrotreater to have higher capital and/or operating costs, such as including additional hydrogen, in order to produce a fuel product, such as diesel, with a sufficiently low specification of certain contaminants, such as sulfur or nitrogen. Furthermore, due to the processing of a distillate with unsatisfactory levels of impurities from a hydroconversion process, this product must be severely hydrotreated, which can raise the cost of this unit. As a consequence, there is a desire to provide an improved scheme that can allow the efficient and effective use of various units within a refining complex.

SUMMARY OF THE INVENTION

One exemplary embodiment can be a process for converting a hydrocarbon stream. The process can include passing the hydrocarbon stream having one or more $C40^+$ hydrocarbons to a slurry hydrocracking zone to obtain a distillate hydrocarbon stream having one or more C9-C22 hydrocarbons, and passing the distillate hydrocarbon stream to a hydrocracking zone for selectively hydrocracking aromatic compounds including at least two rings obtaining a processed distillate product.

Another exemplary embodiment may be a process for converting a hydrocarbon stream. The process can include passing the hydrocarbon stream having one or more $C40^+$ hydrocarbons to a thermal conversion zone to obtain a distillate hydrocarbon stream having one or more C9-C22 hydrocarbons from the thermal conversion zone, and passing the distillate hydrocarbon stream to a hydrocracking zone for selectively hydrocracking aromatic compounds having at least two rings obtaining a processed distillate product.

A further example can be a process for producing a processed distillate product. The process may include passing a hydrocarbon stream to a thermal conversion zone to obtain a distillate hydrocarbon stream and a gas oil stream, passing the gas oil stream to a gas oil hydrotreatment zone to obtain a hydrotreated gas oil, passing the hydrotreated gas oil to a fluid catalytic cracking zone to obtain a light cycle oil, passing the light cycle oil to a hydrocracking zone for selectively hydrocracking aromatic compounds obtaining the processed distillate product, and recycling at least a portion of the processed distillate product from the selective hydrocracking zone to the fluid catalytic cracking zone. Generally, the hydrocarbon stream includes one or more $C40^+$ hydrocarbons and the aromatic compounds include at least two rings.

The embodiments disclosed herein can redirect light coker gas oil or distillate streams to an inlet of a selective hydrocracking zone. This process scheme can combine the low quality vacuum gas oil and crude distillate streams, typically having higher levels of sulfur and nitrogen, and segregate them from higher quality hydrotreated distillate streams. As a result, a distillate hydrotreater can be provided with lower capital and operating costs for producing fuels, such as diesel or gasoline, that meet rigorous regulatory requirements for contaminants, such as sulfur or nitrogen. Moreover, the process scheme disclosed herein can increase the capacity of the selective hydrocracking zone to improve the economics of the apparatus.

DEFINITIONS

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "riser reactor" generally means a reactor used in a fluid catalytic cracking process that can include a riser, a reaction vessel, and a stripper. Usually, such a reactor may include providing catalyst at the bottom of a riser that proceeds to a reaction vessel having a mechanism for separating the catalyst from a hydrocarbon.

As used herein, the term "rich" can mean an amount of at least generally about 50%, and preferably about 70%, by mole, of a compound or class of compounds in a stream.

As used herein, the term "substantially" can mean an amount of at least generally about 80%, preferably about 90%, and optimally about 99%, by mole, of a compound or class of compounds in a stream.

As depicted, process flow lines in the figures can be referred to interchangeably as, e.g., lines, pipes, feeds, products, oils, or streams.

As used herein, the term "vapor" can mean a gas or a dispersion that may include or consist of one or more hydrocarbons.

As used herein, the term "overhead stream" can mean a stream withdrawn at or near a top of a column, typically a distillation column.

As used herein, the term "bottom stream" can mean a stream withdrawn at or near a bottom of a column, typically a distillation column.

As used herein, the term "liquefied petroleum gas" may be abbreviated as "LPG".

As used herein, the term "liquid hourly space velocity" may be abbreviated as "LHSV".

As used herein, the terms "normal meter cubed of hydrogen per meter cubed of hydrocarbons" may be abbreviated "normal $m^3/m^3$".

As used herein, the term "Research Octane Number" may be abbreviated "RON".

As used herein, the term "boiling point temperature" can mean the atmospheric equivalent boiling point (may be abbreviated as "AEBP") as calculated from the observed boiling temperature and the distillation pressure, as calculated using the equations furnished in ASTM D1160 appendix A7 entitled "Practice for Converting Observed Vapor Temperatures to Atmospheric Equivalent Temperatures", and AEBP can be determined by any standard gas chromatographic simulated distillation method such as ASTM D2887, D6352 or D7169, all of which are used by the petroleum industry.

As used herein, the term "naphtha" can mean a hydrocarbon material boiling in a range of about 25-about 190° C., and can include one or more C5-C10 hydrocarbons.

As used herein, the term "light naphtha" can mean a hydrocarbon material boiling in a range of about 25-about 85° C., and can include one or more C5-C6 hydrocarbons.

As used herein, the term "heavy naphtha" can mean a hydrocarbon material boiling in a range of about 85-about 190° C., and can include one or more C6-C10 hydrocarbons.

As used herein, the term "gas oil" can mean a hydrocarbon material boiling in a range of about 204-about 524° C., and can include one or more C13-C25 hydrocarbons.

As used herein, the terms "light gas oil" can hereinafter be abbreviated "LGO" and "light cycle oil" may hereinafter be abbreviated "LCO" and collectively may mean a hydrocarbon material boiling in a range of about 204-about 343° C., and can include one or more C13-C18 hydrocarbons.

As used herein, the term "heavy gas oil" can hereinafter be abbreviated "HGO" and mean a hydrocarbon material boiling in a range of about 343-about 524° C., and can include one or more C16-C25 hydrocarbons.

As used herein, the term "vacuum gas oil" may hereinafter be abbreviated "VGO" and can mean a hydrocarbon material boiling in the range of about 343-about 524° C., and can include one or more C22-C45 hydrocarbons.

As used herein, "light vacuum gas oil" may hereinafter be abbreviated "LVGO" and can mean a hydrocarbon material boiling in a range of about 343-about 427° C.

As used herein, "heavy vacuum gas oil" may hereinafter be abbreviated "HVGO" and can mean a hydrocarbon material boiling in a range of about 427-about 524° C.

As used herein, the term "pitch" or "vacuum bottoms" can mean a hydrocarbon material boiling above about 524° C., and can include one or more $C40^+$ hydrocarbons.

DETAILED DESCRIPTION

Figure 1:
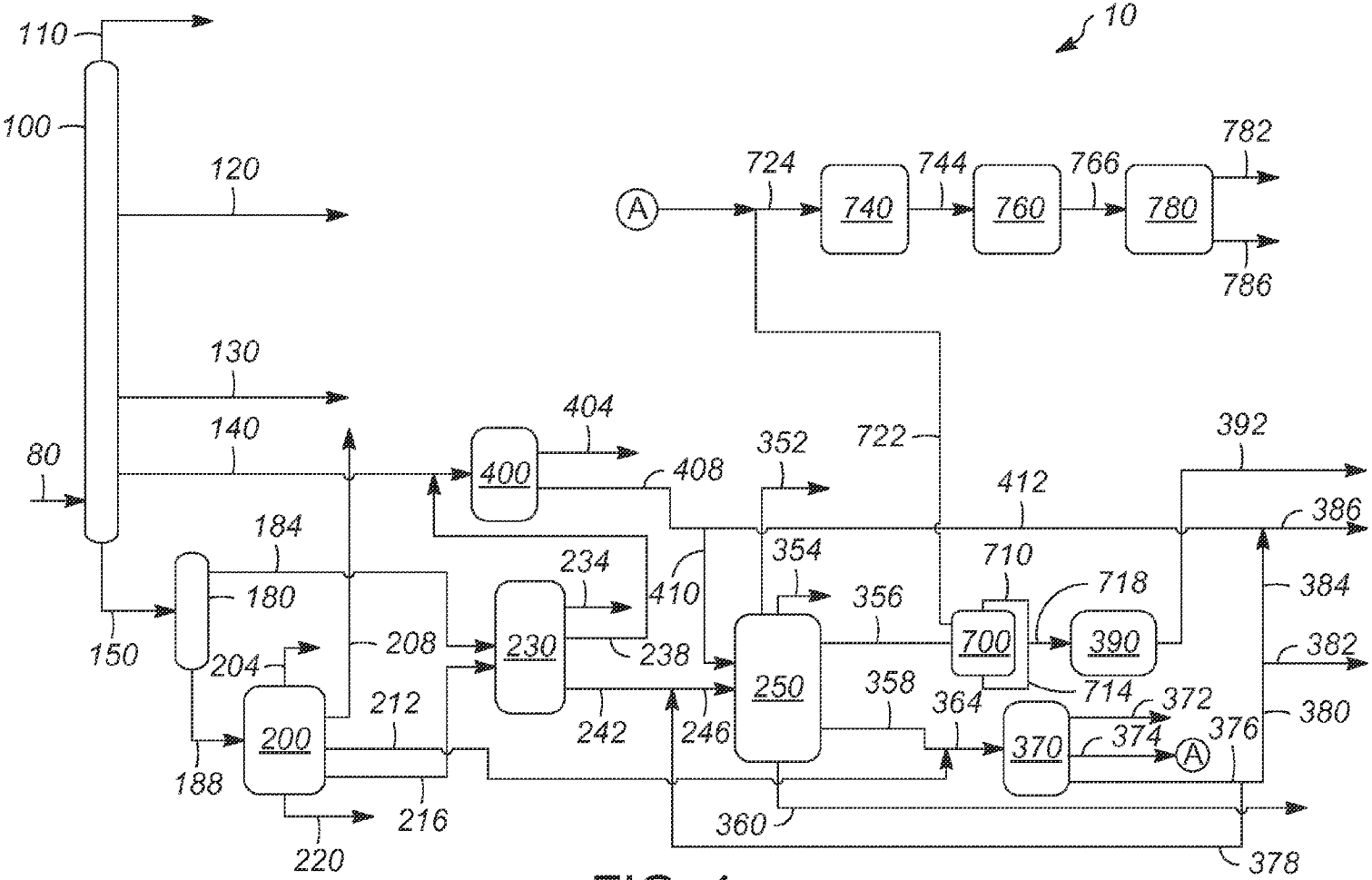
FIG. 1 is a schematic depiction of an exemplary refining-petrochemical apparatus.

Referring to FIG. 1, an exemplary refining-petrochemical apparatus 10 can include a crude fractionation zone 100, a vacuum distillation zone 180, a thermal conversion zone 200, a gas oil hydrotreatment zone 230, a fluid catalytic cracking zone 250, a selective hydrocracking zone 370, a selective hydrotreating zone 390, a distillate hydrotreatment zone 400, a naphtha separation zone 700, a hydrotreatment zone 740, a reforming zone 760, and an aromatic zone 780. A crude oil stream 80 can be provided to the crude fractionation zone 100. Generally, the crude oil stream 80 can include about 15-about 60%, by weight, alkanes, about 30-about 60%, by weight, cycloalkanes, about 3-about 30%, by weight, aromatics, and up to about 6%, by weight, asphaltics. Often, the crude oil stream 80 can undergo one or more processes such as dewatering and desalting prior to entering the crude fractionation zone 100. During distillation, several fractions with varying distillation points can be obtained, such as an LPG stream 110, a naphtha stream 120, a kerosene stream 130, a crude distillation stream 140, and an atmospheric residue stream 150. An exemplary atmospheric distillation process is disclosed in, e.g., U.S. Pat. No. 6,454,934. The streams 110, 120, and 130 can be further processed through any suitable zone.

With respect to the atmospheric residue stream 150, the atmospheric residue stream 150 can be provided to the vacuum distillation zone 180. The vacuum distillation zone 180 can include a column maintained at a pressure of about 1.7-about 10.0 kPa and at a temperature of about 250-about 500° C. The vacuum distillation zone 180 can provide a vacuum gas oil stream 184 and a hydrocarbon or vacuum bottoms stream 188.

The hydrocarbon stream 188 can include any suitable hydrocarbons and can include one or more $C40^+$ hydrocarbons. In addition, although the hydrocarbon stream 188 is shown being obtained from the bottom of a vacuum distillation zone 180, it should be understood that the hydrocarbon stream 188 can be obtained from any suitable source, such as an atmospheric residue stream 150. Moreover, the hydrocarbon stream 188 can include or be replaced with at least one of a vacuum resid, a visbroken tar, an atmospheric residue, a slurry oil, a hydrotreated resid, a tar sand, and a pitch.

The hydrocarbon stream 188 can be provided to the thermal conversion zone 200. The thermal conversion zone 200 can be any suitable process, such as a delayed coking zone or a slurry hydrocracking zone, as hereinafter described. The thermal conversion zone 200 can provide an LPG stream 204, a naphtha stream 208, a distillate hydrocarbon stream 212, a gas oil stream 216, and a pitch stream 220. Alternatively, the pitch stream 220 can be a coke stream 220 from, e.g., a delayed coking zone. The streams 204, 208, and 220 can be provided to any suitable destination for further processing and purification. As an example, the naphtha stream 208 can be provided to the hydrotreatment zone 740. The distillate hydrocarbon stream 212, including one or more C9-C22 hydrocarbons, can be combined with a light cycle oil stream 358 prior to being processed in the selective hydrocracking zone 370, as hereinafter described, and the gas oil stream 216 can be provided to the gas oil hydrotreatment zone 230.

The gas oil hydrotreatment zone 230 can also receive the vacuum gas oil stream 184 from the vacuum distillation zone 180 as well as the gas oil stream 216. The gas oil hydrotreatment zone 230 can utilize any suitable catalyst, such as a catalyst including one or more elements of groups 6 and 8-10 of the Periodic Table and a support. As an example, the catalyst can include molybdenum and nickel and/or cobalt and a support having an alumina, an alumina-silica, and alumina-silica containing zeolites. The gas oil hydrotreatment zone 230 can operate at any suitable conditions, such as a temperature of about 390-about 430° C., a hydrogen concentration of about 180-about 2,700 normal $m^3/m^3$, and an LHSV of about 0.5-about 3.5 $hr^{-1}$. An exemplary gas oil hydrotreatment zone is disclosed in, e.g., U.S. Pat. No. 4,420,388.

Typically, the gas oil hydrotreatment zone 230 provides a hydrotreated naphtha stream 234, a hydrotreated distillate stream 238, and a hydrotreated gas oil stream 242. Generally, the streams 234, 238 and 242 can be provided to any suitable destination. As an example, the hydrotreated distillate stream 238 can be combined with the crude distillation stream 140 and subsequently provided to the distillate hydrotreatment zone 400. The distillate hydrotreatment zone 400 can provide a naphtha stream 404 and a distillate stream 408. The hydrotreated gas oil stream 242 can be combined with a recycled distillate product 378, as hereinafter described, to provide a combined stream 246 to the fluid catalytic cracking zone 250. In addition to receiving the combined stream 246, the fluid catalytic cracking zone 250 may optionally receive a first portion of a distillate stream 410 from the distillate hydrotreatment zone 400.

Figure 2:
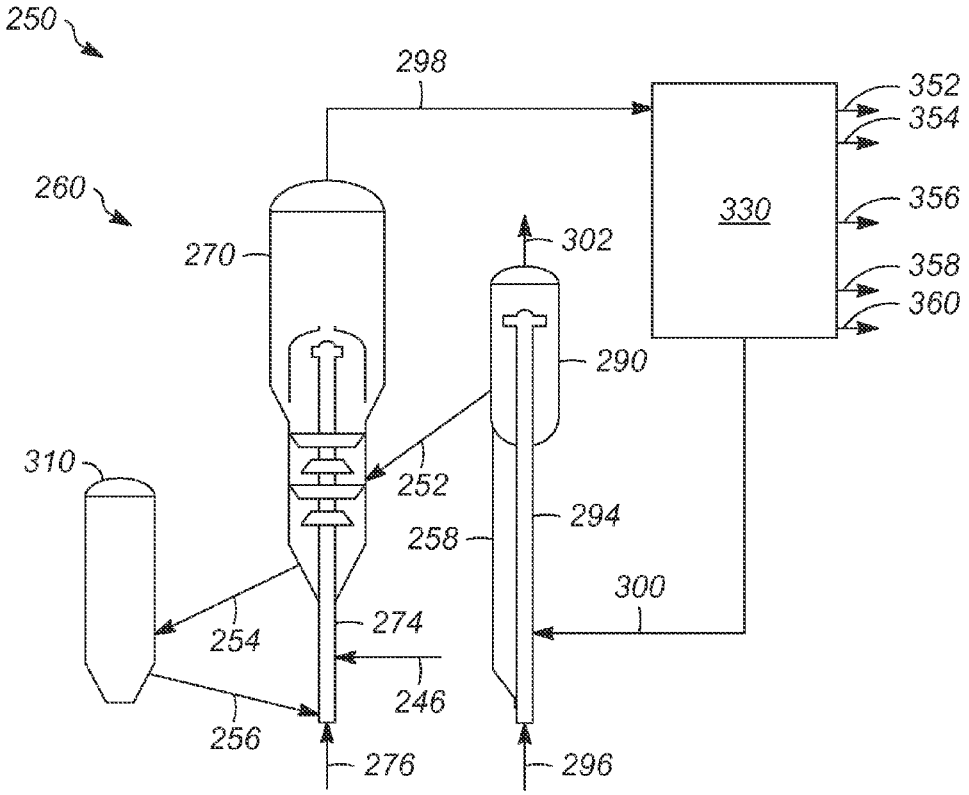
FIG. 2 is a schematic depiction of an exemplary fluid catalytic cracking zone.

Referring to FIG. 2, the fluid catalytic cracking zone 250, can include at least one riser reactor 260, namely a first riser reactor 270 and a second riser reactor 290. In addition, the fluid catalytic cracking zone 250 may also include a regeneration vessel 310 and a fractionation zone 330. Such a fluid catalytic cracking zone 250 is disclosed in, e.g., US 2010/0168488.

Although the first riser reactor 270 is depicted, it should be understood that any suitable reactor or reaction vessel can be utilized, such as a fluidized bed reactor or a fixed bed reactor. Generally, the first riser reactor 270 can include a first riser 274 terminating in a reaction vessel. The first riser 274 can receive the combined stream 246 that can have a boiling point range of about 180-about 800° C.

Usually, the combined stream 246 can be provided at any suitable height on the first riser 274, such as above a lift gas line 276 providing a lift gas, such as steam and/or a light hydrocarbon, to the first riser 274. The combined stream 246 may be provided at a distance sufficient to provide a good dispersion of the up-flowing feed and/or catalyst, if desired.

The catalyst can be a single catalyst or a mixture of different catalysts. Usually, the catalyst includes two components or catalysts, namely a first component or catalyst, and a second component or catalyst. Generally, the first component may include any of the well-known catalysts that are used in the art of fluid catalytic cracking, such as an active amorphous clay-type catalyst and/or a high activity, crystalline molecular sieve. Zeolites may be used as molecular sieves in fluid catalytic cracking processes. Preferably, the first component includes a large pore zeolite, such as a Y-type zeolite, an active alumina material, a binder material, including either silica or alumina, and an inert filler such as kaolin.

Typically, the zeolitic molecular sieves appropriate for the first component have a large average pore size. Usually, molecular sieves with a large pore size have pores with openings of greater than about 0.7 nm in effective diameter defined by greater than about 10, and typically about 12, member rings. Pore Size Indices of large pores can be above about 31. Suitable large pore zeolite components may include synthetic zeolites such as X and Y zeolites, mordenite and faujasite. A portion of the first component, such as the zeolite, can have any suitable amount of a rare earth metal or rare earth metal oxide.

The second component may include a medium or smaller pore zeolite catalyst, such as an MFI zeolite, as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second component has the medium or smaller pore zeolite dispersed on a matrix including a binder material such as silica or alumina and an inert filler material such as kaolin. The second component may also include some other active material such as Beta zeolite. These compositions may have a crystalline zeolite content of about 10-about 50% or more, by weight, and a matrix material content of about 50-about 90%, by weight. Components containing about 40%, by weight, crystalline zeolite material are preferred, and those with greater crystalline zeolite content may be used. Generally, medium and smaller pore zeolites are characterized by having an effective pore opening diameter of less than or equal to about 0.7 nm, rings of about 10 or fewer members, and a Pore Size Index of less than about 31.

Typically, the combined stream 246 and the catalyst mixture can be provided proximate to the bottom of the first riser 274. Usually, the first riser 274 operates with dilute phase conditions above the point of feed injection with a density that is less than about 320 $kg/m^3$. Generally, the combined stream 246 is introduced into the first riser 274 by a nozzle. Usually, the combined stream 246 has a temperature of about 140-about 320° C. Moreover, additional amounts of feed may also be introduced downstream of the initial feed point.

In addition, the first riser reactor 270 can be operated at low hydrocarbon partial pressure in one desired embodiment. Generally, a low hydrocarbon partial pressure can facilitate the production of light alkenes. Accordingly, the first riser 274 pressure can be about 170-about 250 kPa, with a hydrocarbon partial pressure of about 35-about 180 kPa, preferably about 70-about 140 kPa. A relatively low partial pressure for hydrocarbon may be achieved by using steam as a diluent, in the amount of about 10-about 55%, by weight, preferably about 15%, by weight, of the feed. Other diluents, such as dry gas, can be used to reach equivalent hydrocarbon partial pressures.

The one or more hydrocarbons and catalyst rise to the reaction vessel converting the combined stream 246. Usually, the combined stream 246 reacts within the first riser 274 to form one or more products. The first riser 274 can operate at any suitable temperature and typically operates at a temperature of about 150-about 580° C., preferably about 520-about 580° C. Exemplary risers are disclosed in, e.g., U.S. Pat. Nos. 5,154,818 and 4,090,948.

The products can rise within the first riser 274 and exit within the reaction vessel. Typically, products including propene and gasoline are produced. Subsequently, the catalyst can separate assisted by any suitable device, such as swirl arms, and settle to the bottom of the reaction vessel. In addition, a first mixture including one or more products and any remaining entrained catalyst can rise into a disengagement zone. In the disengagement zone, any remaining entrained catalysts can be separated. Usually, the disengagement zone can include separation devices, such as one or more cyclone separators for separating out the products from the catalyst particles. Dip legs can drop the catalyst down to the base of a shell to a dense catalyst bed. Exemplary separation devices and swirl arms are disclosed in, e.g., U.S. Pat. No. 7,312,370. The catalyst can pass through the stripping zone where absorbed hydrocarbons can be removed from the surface of this catalyst by counter-current contact with steam. An exemplary stripping zone is disclosed in, e.g., U.S. Pat. No. 7,312,370. Afterwards, the catalyst can be regenerated, as discussed below.

The one or more products leaving the disengagement zone of the first riser reactor 270 can exit as a product stream 298 to the fractionation zone 330. Generally, the fractionation zone 330 can receive the product stream 298 and other streams. Typically, the fractionation zone 330 can include one or more distillation columns. Such zones are disclosed in, e.g., U.S. Pat. No. 3,470,084. Usually, the fractionation zone 330 can produce several products, such as a C2 hydrocarbon stream 352, an LPG stream 354, a cracked naphtha stream 356, the light cycle oil stream 358, and a clarified slurry oil stream 360.

In addition, the fractionation zone 330 can provide a recycle stream 300, which can at least partially be comprised of one or more C4-C10 alkenes produced by the first riser reactor 270 and provided to the second riser reactor 290. Typically, the recycle stream 300 can be provided above a line 296 providing a lift gas, such as steam and/or a light hydrocarbon, to the second riser 294. Optionally, the steam may be provided in the amount of about 5-about 40%, by weight, with respect to the weight of the recycle stream 300. The recycle stream 300 can include at least about 50%, by mole, of the components in a gas phase. Preferably, the entire recycle stream 300, i.e., at least about 99%, by mole, is in a gas phase. Generally, the temperature of the recycle stream 300 can be about 120-about 600° C. when entering the second riser 294.

The second riser 294 may terminate in a reaction vessel. In addition, catalyst may be recycled via a line 258 from the reaction vessel. Although the second riser reactor 290 is depicted as a riser reactor, it should be understood that any suitable reactor can be utilized, such as a fixed bed or a fluidized bed. In some embodiments, the second riser reactor 290 can contain a mixture of the first and second components as described above.

In one preferred embodiment, the second riser reactor 290 can contain less than about 20%, preferably about 5%, by weight, of the first component and at least about 20%, by weight, of the second component. In one preferred embodiment, the catalyst mixture can include at least about 20%, by weight, of a ZSM-5 zeolite and less than about 50%, preferably about 5%, by weight, of a Y-zeolite. In another preferred embodiment, the second riser reactor 290 can contain only the second component, preferably a ZSM-5 zeolite. The second mixture, catalyst, or component can be provided directly to the second riser reactor 290 and periodically be dispensed through a line 252 to the first riser reactor 270.

Usually, the second riser reactor 290 can be isolated from the regeneration vessel 310 so that regenerated catalyst is only returned to the first riser reactor 270. Typically, the second riser reactor 290 does not receive regenerated catalyst from the regeneration vessel 310. Rather, the regeneration vessel 310 can communicate directly with the first riser reactor 270 and does not directly communicate with the second riser reactor 290.

The second riser reactor 290 can operate in any suitable condition, such as a temperature of about 425-about 705° C., preferably a temperature of about 550-about 600° C., and a pressure of about 40-about 700 kPa, preferably a pressure of about 40-about 400 kPa, and optimally a pressure of about 200-about 250 kPa. Typically, the residence time of the second riser reactor 290 can be less than about 4 seconds, or less than about 3.5 seconds. Exemplary risers and/or operating conditions are disclosed in, e.g., US 2008/0035527 and U.S. Pat. No. 7,261,807.

Generally, the hydrocarbons and the catalyst can rise to the second riser reactor 290 and the catalyst and the hydrocarbon products can separate. The catalyst can drop to a dense catalyst bed within the reaction vessel and optionally be provided to the base of the second riser reactor 290. Alternatively, spent catalyst can be periodically withdrawn from the second riser reactor 290 via a line 252 to the first riser reactor 270 and replaced by fresh catalyst to maintain activity in the second riser reactor 290. Generally, the second riser reactor 290 may operate under conditions to convert the hydrocarbons into one or more light alkenes, such as ethene and/or propene. Afterwards, the hydrocarbon products can separate and exit as a second riser reactor product stream 302.

The catalyst utilized in the first riser reactor 270 and the second riser reactor 290 can be separated from the hydrocarbons. As such, the catalysts can settle into the stripping zone of the first riser reactor 270. Next, the stripped catalyst via a line 254 can enter the regeneration vessel 310. The regeneration vessel 310 can be operated at any suitable conditions, such as a temperature of about 600-about 800° C., and a pressure of about 160-about 650 kPa. Exemplary regeneration vessels are disclosed in, e.g., U.S. Pat. Nos. 7,312,370 and 7,247,233. Afterwards, the regenerated catalyst can be provided to the first riser reactor 270 via a line 256 and optionally to the second riser 294.

The fractionation zone 330 of the fluid catalytic cracking zone 250, referring back to FIG. 1, can produce the C2 hydrocarbon stream 352, LPG stream 354, cracked naphtha stream 356, light cycle oil stream 358, and clarified slurry oil stream 360, as discussed above. Generally, the streams 352, 354, and 360 can be provided to any suitable destination for further processing to produce higher valued products or for purification. The cracked naphtha stream 356 may be provided to the naphtha separation zone 700, as hereinafter described, and the light cycle oil stream 358 can be combined with the distillate hydrocarbon stream 212 to form a feed 364 to the selective hydrocracking zone 370.

The selective hydrocracking zone 370 can be operated at any suitable conditions to selectively crack multiple-ring aromatic compounds while minimizing cracking of single ring aromatic compounds. Usually, a catalyst includes a zeolite, and one or more metals from groups 6 and 8-10 of the Periodic Table. Such metals can include at least one of iron, cobalt, nickel, ruthenium, rhodium, palladium, osmium, indium, platinum, molybdenum, and tungsten. The selective hydrocracking zone 370 can operate at any suitable conditions, such as a temperature of about 230-about 460° C., preferably about 300-about 450° C., and a pressure of about 3.5-about 21 MPa, preferably about 6-about 8.5 MPa. The LHSV can be about 0.2-about 20 $hr^{-1}$, and a hydrogen circulation rate of about 300-about 2,600 normal $m^3/m^3$. An exemplary selective hydrocracking process is disclosed in, e.g., U.S. Pat. No. 5,007,998.

The selective hydrocracking zone 370 can provide a light naphtha stream 372, a hydrocracked heavy naphtha stream 374, and a processed distillate product or diesel product 376. Typically, the feed 364 is in the distillate range. So, the distillate product 376 may be processed, usually by hydrotreating, but not hydrocracked. Although not wanting to be bound by theory, the double or greater ring aromatics in the feed 364 can be converted to single ring aromatics. The hydrocracked heavy naphtha stream 374 can contain the hydrocracked single ring species. In this exemplary embodiment, the hydrocracked heavy naphtha stream 374 can be sent to point "A" and added to the aromatic stream 722 to form a combined stream 724, as hereinafter described.

Generally, a portion of the processed distillate product 376 can be provided as a recycle stream, namely a recycled distillate product 378 and combined with a hydrotreated gas oil stream 242 to form the combined stream 246 to the fluid catalytic cracking zone 250. The mass ratio of the recycled distillate product 378 to the feed 364 to the selective hydrocracking zone 370 can be about 0.05:1-about 0.95:1, desirably about 0.1:1-about 0.5:1. The selective hydrocracking zone 370 conversion per pass can be about 70%, by weight. In one exemplary embodiment, the selective hydrocracking zone 370 operates at a pressure of less than about 7,000 kPa. A remainder distillate product 380 can be further split into a distillate product stream 382 that can be provided to any suitable destination, such as a low sulfur distillate fuel, and a second portion of a distillate product 384, which can be combined with the second portion of the distillate stream 412 to form a combined product stream 386 that can be provided to any suitable destination, such as a diesel fuel, preferably with a low sulfur specification as measured by the cetane index.

Figure 4:
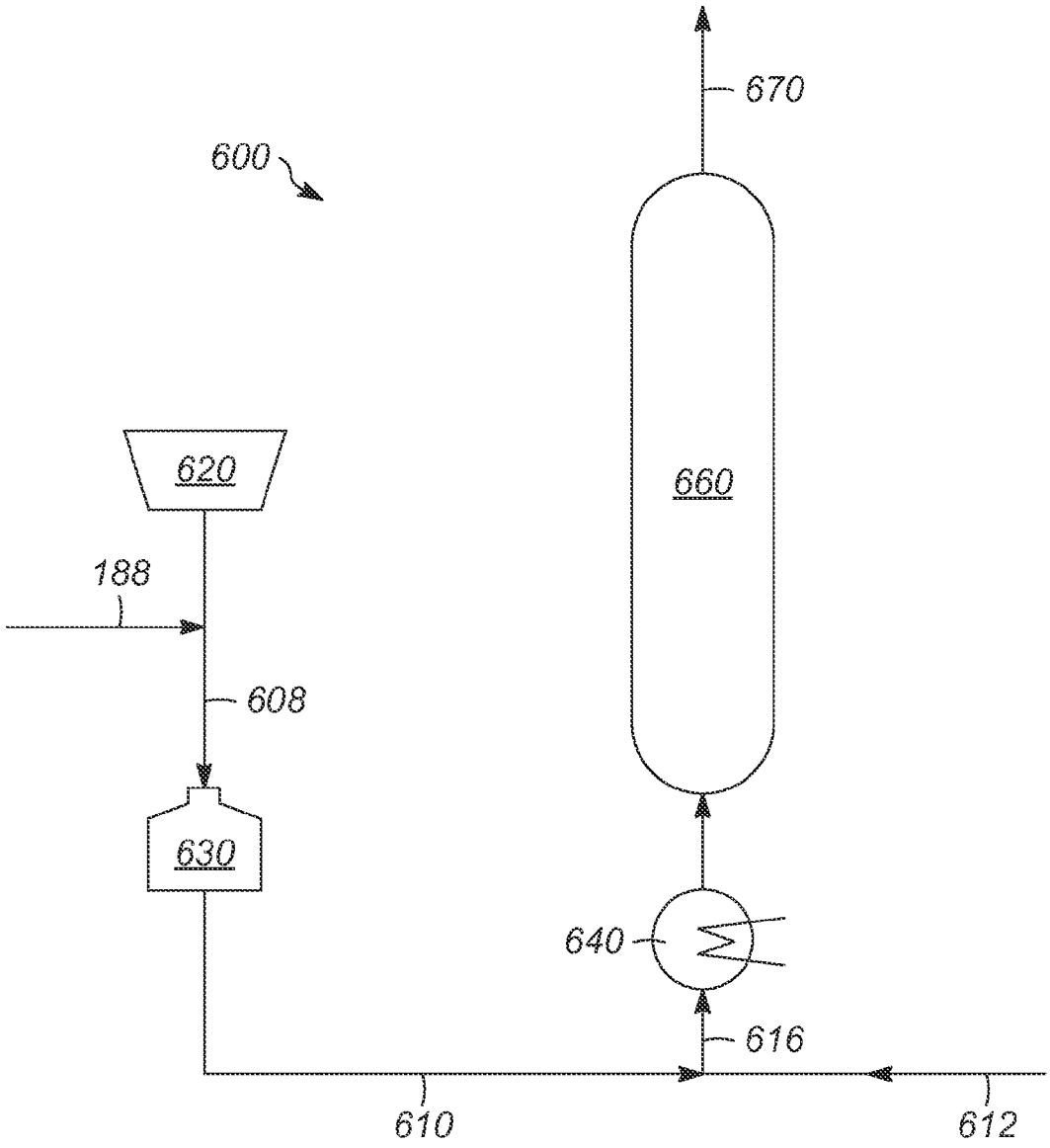
FIG. 4 is a schematic depicture of an exemplary slurry hydrocracking zone.

In some embodiments, it may be desirable to send the cracked naphtha stream 356 from the fluid catalytic cracking zone 250 to the naphtha separation zone 700, particularly if the thermal conversion zone 200 is a slurry hydrocracking zone 600 as depicted in FIG. 4, or if a combined feed stream 246 to fluid catalytic cracking zone 250 contains a coker gas oil or slurry hydrocracking gas oil. In such a case, additional aromatic material may be created as compared to other thermal conversion zones. Alternatively, the cracked naphtha stream 356 may be recovered.

The naphtha separation zone 700 can provide a first naphtha portion 710, a second naphtha portion 714, and an aromatic stream 722. Generally, the first naphtha portion 710 can be an overhead stream from a distillation column and the second naphtha portion 714 can be a bottom stream from a distillation column. These portions 710 and 714 can form a combined feed 718 to the selective hydrotreating zone 390 that can operate at any suitable condition to substantially remove the contaminants in the combined feed 718 including sulfur and/or nitrogen compounds while minimizing the saturation of alkene species.

As an example, the selective hydrotreating zone 390 can include a catalyst having one or more metals of groups 6, and 8-10 of the Periodic Table, such as molybdenum and cobalt, and a support having magnesium and alkali metal oxides, as well as at least one of alumina and silica. The selective hydrotreating zone 390 can operate at a temperature of about 140-about 400° C., and a pressure of about 440-about 4,300 kPa. In addition, any suitable hydrogen circulation rates and liquid hourly space velocity for facilitating the reaction may be utilized. A selective refining process is disclosed in, e.g., U.S. Pat. No. 5,348,928. The selective hydrotreating zone 390 can provide a gasoline product 392 that generally has low sulfur amounts to meet stringent regulatory requirements. The gasoline product 392 may be provided to a pool containing a gasoline blended-stock product.

Typically, the aromatic stream 722 is a side-stream from a distillation column that can be combined with the hydrocracked heavy naphtha stream 374 to form the combined stream 724 provided to the hydrotreatment zone 740. Preferably, the aromatic stream 722 is a naphtha cut. The hydrotreatment zone 740 can include a naphtha hydrotreater having a naphtha hydrotreating catalyst. Usually, the catalyst is composed of a first component of cobalt oxide or nickel oxide, along with a second component of molybdenum oxide or tungsten oxide, and a third component of an inorganic oxide support, which is typically a high purity alumina. Generally the cobalt oxide or nickel oxide component is in the range of about 1-about 5%, by weight, and the molybdenum oxide component is in the range of about 6-about 25%, by weight. The balance of the catalyst can be alumina so all components sum up to about 100%, by weight. One exemplary catalyst is disclosed in, e.g., U.S. Pat. No. 7,005,058. Typical hydrotreating conditions include an LHSV of about 0.5-about 15 $hr^{-1}$, a pressure of about 690-about 6,900 kPa, and a hydrogen flow of about 20-about 500 normal $m^3/m^3$.

The hydrotreatment zone 740 can, in turn, provide a hydrotreated effluent 744 to a reforming zone 760. In the reforming zone 760, alkanes and cycloalkanes may be converted to one or more aromatic compounds. Typically, the reforming zone 760 runs at very high severity, equivalent to producing about 100-about 106 RON gasoline reformate, in order to maximize the production of one or more aromatic compounds.

In the reforming zone 760, the hydrocarbon stream is contacted with a reforming catalyst under reforming conditions. Typically, the reforming catalyst is composed of at least one platinum-group metal, at least one modifier metal, and at least one inorganic-oxide support, which can be high purity alumina Generally, the platinum-group metal is about 0.01-about 2.0%, by weight, and the modifier metal component is about 0.01-about 5%, by weight. The balance of the catalyst composition can be alumina to sum all components up to about 100%, by weight. The platinum-group metal can be at least one platinum, palladium, rhodium, ruthenium, osmium, and iridium. The metal modifier may include rhenium, tin, germanium, lead, cobalt, nickel, indium, gallium, zinc, uranium, dysprosium, thallium, or a mixture thereof. One reforming catalyst for use in the present invention is disclosed in, e.g., U.S. Pat. No. 5,665,223. Usually reforming conditions include an LHSV of about 0.5-about 15.0 $hr^{-1}$, a ratio of hydrogen to hydrocarbon of about 0.5-about 10 moles of hydrogen per mole of hydrocarbon feed entering the reforming zone 760, and a pressure of about 69-about 4,830 kPa. The reforming zone 760 can, in turn, provide a reformate stream 766 to an aromatic zone 780. The hydrotreatment zone 740 and the reforming zone 760 can be any suitable zone, such as those disclosed in, e.g., U.S. Pat. No. 7,727,490.

The aromatic zone 780 can be any suitable aromatic complex that provides suitable zones, such as an extraction zone, a transalkylation zone, a para-xylene separation zone, and an alkyl aromatic isomerization zone and suitable fractionation zones to provide a benzene stream 782, and one or more xylenes stream 786. Such a suitable aromatic zone is discussed in, e.g., U.S. Pat. Nos. 6,740,788, 7,169,368, and 7,727,490.

Figure 3:
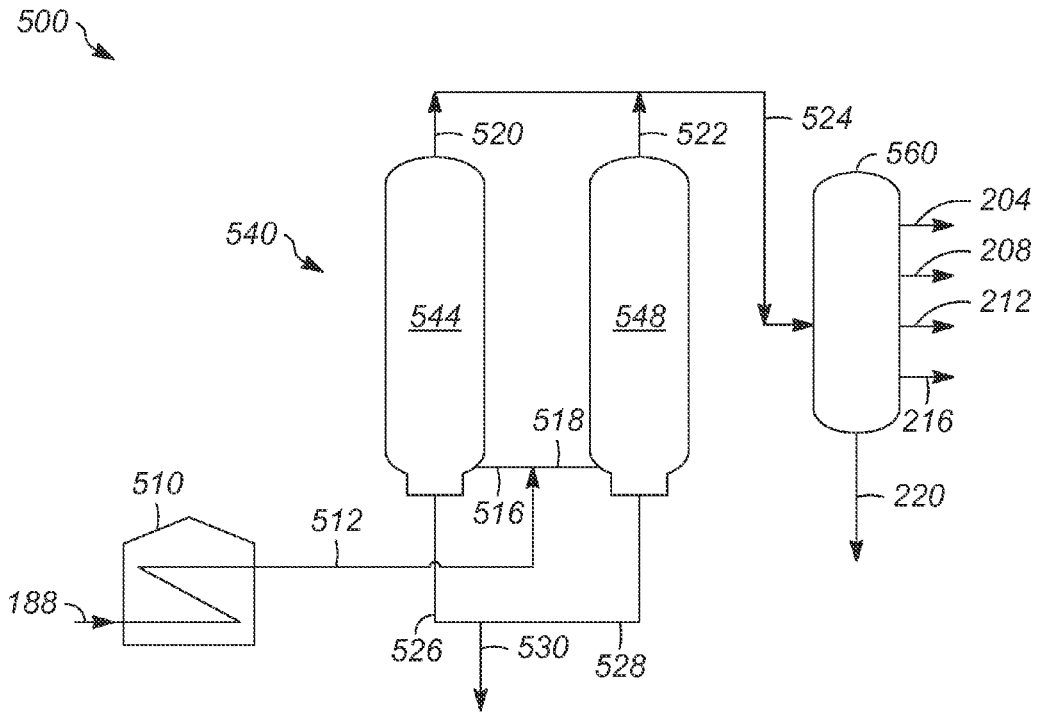
FIG. 3 is a schematic depicture of an exemplary delayed coking zone.

Referring to FIG. 3, one exemplary example of a thermal conversion zone 200 is a delayed coking zone 500. An exemplary delayed coking zone is disclosed in, e.g., U.S. Pat. No. 4,388,152. The hydrocarbon stream 188 can be provided to the delayed coking zone 500, and be passed through a furnace 510 to a plurality of coke drums 540, including a first coke drum 544 and a second coke drum 548. Generally, the hydrocarbon stream 188 is sent in a line 512 and a respective line 516 or 518 to one of a first coke drum 544 or a second coke drum 548. In operation, the hydrocarbons are heated and fed into the bottom of a coking drum 544 or 548 where the first stages of thermal decomposition reduce the hydrocarbons to a very heavy tar or pitch which further decomposes into solid coke. Typically, the vapors formed during the decomposition produce pores and channels in the coke through which the incoming oil from the furnace may pass. This process may continue usually until the drum is filled to a desired level with a mass of coke. The vapors formed in the process can exit the top of the first and second coking drums 544 and 548 via lines 520 and 522 and are passed for further processing via a line 524. The resulting coke is removed from the first and second coking drums 544 and 548 by the use of, e.g., high pressure water jets, via respective lines 526 and 528 and the line 530. In normal operation, one drum 544 or 548 may be fed with the hydrocarbon stream 188 typically until, e.g., the drum 544 is substantially filled with coke and, thereafter, hydrocarbons may be switched to the other drum 548, which may receive the hydrocarbons and produce coke while the drum 544 is emptied.

The hydrocarbons to the coke fractionator 560 can include the vaporous hydrocarbons recovered from the first or second coking drums 544 and 548 through lines 520 or 522, and the line 524. Optionally, the hydrocarbons may be cooled before charging to coke fractionator 560 that may include one or more distillation columns. The coke fractionator 560 may provide the LPG stream 204, the naphtha stream 208, the distillate hydrocarbon stream 212, the gas oil stream 216, and the coke stream 220. The distillate hydrocarbon stream 212 can be provided to the selective hydrocracking zone 370, and the gas oil stream 216 can be provided to the gas oil hydrotreatment zone 230, as discussed above.

Alternatively, a slurry hydrocracking zone 600 may be used as the thermal conversion zone 200. Referring to FIG. 4, an exemplary slurry hydrocracking zone 600 is depicted. The slurry hydrocracking zone 600 may include a reservoir 620, a holding tank 630, a heater 640, and a slurry hydroprocessing reactor 660. Exemplary systems are disclosed in, e.g., U.S. Pat. Nos. 5,755,955 and 5,474,977.

A reservoir 620 can provide a catalyst to be combined with the hydrocarbon stream 188. A slurry stream 608, i.e., a combination of the catalyst and the hydrocarbon stream 188 having a solids content of about 0.01-about 10%, by weight, can pass to a holding tank 630 before exiting as a slurry stream 610 and combined with a recycle gas 612.

The recycle gas 612 typically contains hydrogen, which can be once-through hydrogen optionally with no significant amount of recycled gases. Alternatively, the recycle gas 612 can contain recycled hydrogen gas optionally with added hydrogen as the hydrogen is consumed during the one or more hydroprocessing reactions. The recycle gas 612 may be essentially pure hydrogen or may include additives such as hydrogen sulfide or light hydrocarbons, e.g., methane and ethane. Reactive or non-reactive gases may be combined with the hydrogen introduced into the upflow tubular reactor or slurry hydrocracking reactor 660 at the desired pressure to achieve the desired product yields.

A combined feed 616 including the slurry stream 610 and the recycle gas 612 can enter the heater 640. Typically, the heater 640 is a heat exchanger using any suitable fluid such as the slurry hydrocracking reactor 660 effluent or high pressure steam to provide the requisite heating requirement. Afterwards, the heated combined feed can enter the slurry hydrocracking reactor 660. Often, slurry hydroprocessing is carried out using reactor conditions sufficient to crack at least a portion of the hydrocarbon stream 188 to lower boiling products, such as one or more distillate hydrocarbons, naphtha, and/or C1-C4 products. Conditions in the slurry hydrocracking reactor 660 can include a temperature of about 340-about 600° C., a hydrogen partial pressure of about 3.5-about 30 MPa and a space velocity of about 0.1-about 30 volumes of the hydrocarbon stream 188 per hour per reactor or reaction zone volume. A product 670 can exit the slurry hydrocracking reactor 660.

Generally, the catalyst for the slurry hydrocracking reactor 660 provides a composition that is hydrophobic and resists clumping. Consequently, it may be suitable and easily combined with the hydrocarbon stream 188. Typically, the slurry catalyst composition can include a catalytically effective amount of one or more compounds having iron. Particularly, the one or more compounds can include at least one of an iron oxide, an iron sulfate, and an iron carbonate. Other forms of iron can include at least one of an iron sulfide, a pyrrhotite, and a pyrite. What is more, the catalyst can contain materials other than an iron, such as at least one of molybdenum, nickel, and manganese, and/or a salt, an oxide, and/or a mineral thereof. Preferably, the one or more compounds includes an iron sulfate, and more preferably, at least one of an iron sulfate monohydrate and an iron sulfate heptahydrate.

Alternatively, one or more catalyst particles can include about 2-about 45%, by weight, iron oxide and about 20-about 90%, by weight, alumina In one exemplary embodiment, iron-containing bauxite is a preferred material having these proportions. Bauxite can have about 10-about 40%, by weight, iron oxide ($Fe_2O_3$), and about 54-about 84%, by weight, alumina and may have about 10-about 35%, by weight, iron oxide and about 55-about 80%, by weight, alumina Bauxite also may include silica ($SiO_2$) and titania ($TiO_2$) in amounts of usually no more than about 10%, by weight, and typically in amounts of no more than about 6%, by weight Volatiles such as water and carbon dioxide may also be present, but the foregoing weight proportions exclude such volatiles. Iron oxide is also present in bauxite in a hydrated form, but again the foregoing proportions exclude water in the hydrated composition.

In another exemplary embodiment, it may be desirable for the catalyst to be supported. Such a supported catalyst can be relatively resilient and maintain its particle size after being processed. As a consequence, such a catalyst can include a support of alumina, silica, titania, one or more aluminosilicates, magnesia, bauxite, coal and/or petroleum coke. Such a supported catalyst can include a catalytically active metal, such as at least one of iron, molybdenum, nickel, and vanadium, as well as sulfides of one or more of these metals. Generally, the catalyst can have about 0.01-about 30%, by weight, of the catalytic active metal based on the total weight of the catalyst. An exemplary slurry hydrocracking zone 600 is disclosed in, e.g., US 2010/0248946.

Usually, the refining-petrochemical apparatus 10 can permit the selective hydrocracking zone 370 to operate at a lower severity and conversion level in order to minimize the saturation of aromatics. Routing the hydrogen deficient distillate hydrocarbon stream 212 to the selective hydrocracking zone 370 can substantially reduce the amount of hydrogen compared to a hydrotreatment process as required to meet low sulfur specifications for a fuel, such as diesel fuel. The processed distillate product 376 can be blended in the diesel pool up to specification limits, such as cetane limits or into a lower quality sulfur distillate product such as low sulfur distillate fuel. Alternatively, the processed distillate product 376 can be recycled to the fluid catalytic cracking zone 250 for producing additional propene and aromatics. The processed distillate product per pass conversion may be optimized against a diesel product recycle rate. These configuration improvements are merely exemplary and can be incorporated into a wide range of refining and/or petrochemical facilities. Particularly, the above disclosed modifications can be incorporated in refineries producing an aromatic intermediate product as well as those providing fully integrated processes.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for converting a hydrocarbon stream, comprising:

A) passing the hydrocarbon stream comprising one or more $C40^+$ hydrocarbons to a slurry hydrocracking zone to obtain a distillate hydrocarbon stream comprising one or more C9-C22 hydrocarbons; and B) passing the distillate hydrocarbon stream to a hydrocracking zone for selectively hydrocracking aromatic compounds comprising at least two rings obtaining a processed distillate product.

2. The process according to claim 1, wherein the slurry hydrocracking zone operates at a temperature of about 340-about 600° C. and a hydrogen partial pressure of about 3.5-about 30 MPa.

3. The process according to claim 1, wherein the hydrocarbon stream comprises at least one of a vacuum resid, a visbroken tar, an atmospheric resid, a slurry oil, a hydrotreated resid, a tar sand, and a pitch.

4. The process according to claim 1, wherein the selective hydrocracking zone operates at a temperature of about 230-about 460° C. and about 3.5-about 21 MPa.

5. The process according to claim 1, further comprising recycling the processed distillate product from the selective hydrocracking zone to a fluid catalytic cracking zone comprising at least one riser reactor to obtain a cracked naphtha stream.

6. The process according to claim 5, further comprising passing the cracked naphtha stream from the fluid catalytic cracking zone to a naphtha separation zone, separating an aromatic stream, and passing the aromatic stream to an aromatic zone for producing at least one of benzene and one or more xylenes.

7. The process according to claim 6, further comprising passing a hydrocracked heavy naphtha product produced from the selective hydrocracking zone to the aromatic zone.

8. The process according to claim 6, further obtaining from the naphtha separation zone a first naphtha portion and a second naphtha portion and providing the first and second naphtha portions to a selective hydrotreating zone for producing a gasoline blended-stock product.

9. The process according to claim 5, further comprising obtaining a light cycle oil stream from the fluid catalytic cracking zone and passing the light cycle oil stream to the selective hydrocracking zone.

10. The process according to claim 6, further comprising passing the aromatic stream through a hydrotreatment zone and a reforming zone prior to providing to the aromatic zone.

11. The process according to claim 5, wherein a mass ratio of a recycled distillate product to a feed to the selective hydrocracking zone is about 0.05:1-about 0.95:1.

12. The process according to claim 5, wherein a mass ratio of a recycled distillate product to a feed to the selective hydrocracking zone is about 0.1:1-about 0.5:1.

13. The process according to claim 1, further comprising passing a gas oil stream from the slurry hydrocracking zone to a gas oil hydrotreatment zone to obtain a hydrotreated gas oil stream.

14. A process for converting a hydrocarbon stream, comprising:

A) passing the hydrocarbon stream comprising one or more $C40^+$ hydrocarbons to a thermal conversion zone to obtain a distillate hydrocarbon stream comprising one or more C9-C22 hydrocarbons from the thermal conversion zone; and B) passing the distillate hydrocarbon stream to a hydrocracking zone for selectively hydrocracking aromatic compounds comprising at least two rings obtaining a processed distillate product.

15. The process according to claim 14, wherein the thermal conversion zone comprises a slurry hydrocracking reactor.

16. The process according to claim 14, wherein the thermal conversion zone comprises a delayed coking zone.

17. The process according to claim 16, wherein the delayed coking zone comprises a plurality of coke drums and a coke fractionator.

18. The process according to claim 17, further comprising recycling the processed distillate product to a fluid catalytic cracking zone.

19. A process for producing a processed distillate product, comprising:

A) passing a hydrocarbon stream comprising one or more $C40^+$ hydrocarbons to a thermal conversion zone to obtain a distillate hydrocarbon stream and a gas oil stream;

B) passing the gas oil stream to a gas oil hydrotreatment zone to obtain a hydrotreated gas oil;

C) passing the hydrotreated gas oil to a fluid catalytic cracking zone to obtain a light cycle oil;

D) passing the light cycle oil to a hydrocracking zone for selectively hydrocracking aromatic compounds comprising at least two rings obtaining the processed distillate product; and E) recycling at least a portion of the processed distillate product from the selective hydrocracking zone to the fluid catalytic cracking zone.

20. The process according to claim 19, wherein the thermal conversion zone comprises a delayed coking zone or a slurry hydrocracking zone.

* * * * *